US005119840A

United States Patent [19]

Shibata

[11] Patent Number: 5,119,840

[45] Date of Patent: Jun. 9, 1992

[54] ULTRASONIC OSCILLATING DEVICE AND ULTRASONIC WASHING APPARATUS USING THE SAME

[75] Inventor: Hajime Shibata, Tokyo, Japan

[73] Assignee: Kaijo Kenki Co., Ltd., Japan

[21] Appl. No.: 477,725

[22] Filed: Feb. 9, 1990

Related U.S. Application Data

[62] Division of Ser. No. 35,179, Apr. 7, 1987, abandoned.

[30] Foreign Application Priority Data

Apr. 7, 1986 [JP] Japan ..... 61-51645
Apr. 7, 1986 [JP] Japan ..... 61-51647

[51] Int. Cl.[5] ..... B08B 3/10
[52] U.S. Cl. ..... 134/184; 134/186; 68/3 SS; 310/337
[58] Field of Search ..... 134/184, 186, 1; 68/3 SS; 310/334, 337, 323

[56] References Cited

U.S. PATENT DOCUMENTS 3,113,761 12/1963 Plutzman ..... 134/184 X
3,720,402 3/1973 Cummins et al. ..... 134/184 X
3,730,489 5/1973 Morita ..... 134/184 X

*Primary Examiner*—Frankie L. Stinson
*Attorney, Agent, or Firm*—Steinberg & Raskin

[57] ABSTRACT

An ultrasonic oscillating device comprising a base plate and an ultrasonic transducer attached to the base plate. The thickness of the base plate is an integer multiple of approximately a half-wavelength of an oscillation of the base plate in the direction of its thickness under a driving frequency. The base plate may be a quadrilateral such as a square and a rectangle with a length of one side of the quadrilateral being at least a quarter-wavelength of the oscillation. The base plate may be a circle with a length of a diameter of the circle being at least a quarter-wavelength of the oscillation. An ultrasonic washing apparatus comprising a cleaning tank, an ultrasonic multi-frequency oscillator, and the ultrasonic oscillating device is also provided.

9 Claims, 5 Drawing Sheets

ULTRASONIC OSCILLATING DEVICE AND ULTRASONIC WASHING APPARATUS USING THE SAME

This is a division, of application Ser. No. 035,179, filed Apr. 7, 1987, now abandoned.

BACKGROUND OF THE INVENTION

The present invention relates to an ultrasonic oscillating device and to an ultrasonic washing apparatus using the ultrasonic oscillating device.

In a conventional ultrasonic washing apparatus, an ultrasonic oscillating device is directly attached to a cleaning tank such as on the bottom thereof as an oscillating source, and an ultrasonic oscillator is connected to the ultrasonic oscillating device through a cable in order to drive the same.

Such an ultrasonic oscillating device generally comprises a vibrating base plate or diaphragm made of stainless steel and an ultrasonic transducer attached to the vibrating base plate by using an adhesive. In general, the thickness of the vibrating base plate of the ultrasonic oscillating device is determined to be a very small value, for example approximately 1/100 at most with reference to the wavelength of the oscillating frequency of the vibrating base plate oscillating by means of a drive oscillating signal output from the ultrasonic oscillator. For instance, -2 mm in thickness for the vibrating base plate is employed in an ultrasonic washing apparatus frequently using a drive ultrasonic wave having a 28 kHz wavelength.

Further, in general it is necessary to determine a length of one side of the vibrating base plate having a quadrilateral shape such as a square or a rectangle, to be at most a quarter-wavelength of a resonance frequency of the vibrating base plate, in order to effectively resonate the vibrating base plate.

In the conventional ultrasonic washing apparatus, a driving oscillating signal having a monofrequency is fed to the ultrasonic transducer of the ultrasonic oscillating device from the ultrasonic oscillator. The ultrasonic oscillating device emits an ultrasonic wave into a cleaning liquid in the cleaning tank, thereby washing and cleaning an object to be washed in the cleaning liquid of the tank.

However, when the frequency of the drive oscillating signal is determined to be at least 100 kHz, then the vibrating base plate must be extremely thinned. For instance, when the frequency of the drive oscillating signal is determined to be one MHz, then the thickness of the vibrating base plate is at most 0.1 mm. The thinning of the thickness of the vibrating base plate causes a drop in mechanical strength of the vibrating base plate of the ultrasonic oscillating device. In other words, when the ultrasonic oscillating device is mounted onto the bottom of the cleaning tank, the vibrating base plate is deformed by the pressure of the cleaning liquid. Thus, the ultrasonic transducer attached to the vibrating base plate peels off, or in the worst case., the vibrating base plate breaks down. Furthermore, when the thickness of the vibrating base plate is thinned, the vibrating base plate is liable to be deformed when sticking the ultrasonic transducer onto the vibrating base plate. Hence, the sticking operation becomes difficult and troublesome.

Reinforcing the vibrating base plate in order to increase the mechanical strength or to diminish the area of the vibrating base plate has naturally been considered, however new problems arise. For instance, irregular oscillation occurs between the reinforced part and the other part of the base plate, or the oscillating energy propagated to the cleaning liquid is reduced.

Furthermore, when the ultrasonic oscillating device is driven by the ultrasonic wave having a high-frequency of at least 100 kHz, it is not practical to design the length of one side of the quadrilateral vibrating base plate to less than a quarter-wavelength of the resonance frequency of the vibrating base plate, which is too small.

Then, when the length of one side of the quadrilateral vibrating base plate is normally designed to be at least a quarter-wavelength of the resonance frequency of the vibrating base plate, the resonant oscillation is largely damped, especially in the case of a thick vibrating base plate. Accordingly, the effective ultrasonic oscillation of the vibrating base plate cannot be attained.

Moreover, in the conventional ultrasonic washing apparatus, since the ultrasonic oscillating device is driven by the monofrequency drive oscillating signal, a variety of contamination of items to be washed cannot be properly treated. Thus the range of use of the apparatus is limited.

SUMMARY OF THE INVENTION

Accordingly, it is an, object of the present invention to provide an ultrasonic oscillating device, free from the above-noted defects and disadvantages of the prior art, which is capable of generating effective, stable, and even oscillating energy at a high-frequency of a drive ultrasonic signal, and which is strong and reliable.

It is another object of the present invention to provide an ultrasonic washing apparatus using the ultrasonic oscillating device, free from the above-noted defects and disadvantages of the prior art, which is capable of generating effective, stable and even oscillating energy at a high-frequency of a drive ultrasonic signal, which is strong and reliable, and which is capable of properly washing various kinds of dirt or contamination off items to be washed or cleaned.

These and other objects are attained by the present invention which, in one aspect thereof, provides an ultrasonic oscillating device comprising a base plate and an ultrasonic transducer attached to the base plate, wherein a thickness of the base plate is an integer multiple of approximately a half-wavelength of oscillation of the base plate in the direction of its thickness under a driving frequency, and wherein the base plate is a quadrilateral with a length of one side of the quadrilateral being at least a quarter-wavelength of the oscillation of the base plate.

In accordance with another aspect, the present invention provides an ultrasonic washing apparatus comprising a tank for containing cleaning liquid, an ultrasonic oscillating device for emitting an ultrasonic wave into the cleaning liquid of the tank, and an ultrasonic oscillator which outputs a drive oscillating signal to the ultrasonic oscillating device. The ultrasonic oscillator is a multi-frequency oscillator which is capable of outputting the drive oscillating signal having a fundamental frequency and an odd number multiple of the fundamental frequency. The ultrasonic oscillating evice comprises a base plate and an ultrasonic transducer attached to the base plate, in which a thickness of the base plate is an integer multiple of approximately a half-wavelength of an oscillation of the base plate in the direction of its thickness under a driving frequency, and in which the base plate is a quadrilateral with a length of on side to the quadrilateral being at least a quarter-wavelength of the oscillation of the base plate.

In a preferred embodiment of the invention, the base plate is in the shape of a circle instead of the quadrilateral, with a length of a diameter of the circle being at least a quarter-wavelength of the oscillation of the base plate.

BRIEF DESCRIPTION OF THE DRAWINGS

These and other objects, features, and advantages of the present invention will become more fully apparent from the following description thereof with reference to preferred embodiments thereof taken in conjunction with the accompanying drawings, in which.

DESCRIPTION OF THE PREFERRED EMBODIMENTS

Figure 1:
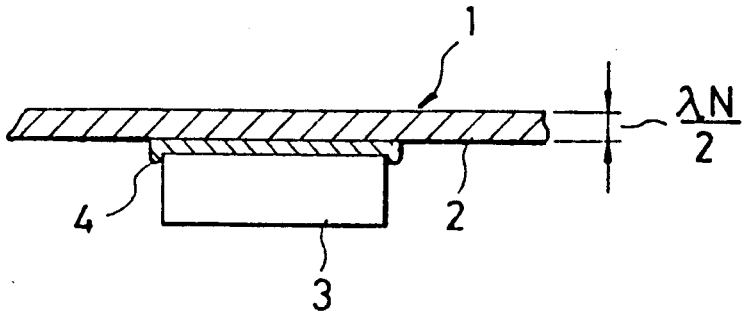
FIG. 1 is a fragmentary, longitudinal, cross-section view of an ultrasonic oscillating device according to the present invention.

Referring to the drawings, in which like reference numerals designate similar or corresponding components throughout the different figures, an ultrasonic oscillating device is shown in FIG. 1 according to the present invention.

In the drawing, the ultrasonic oscillating device 1 according to the present invention comprises a vibrating base plate 2 made of stainless steel and an ultrasonic transducer 3 attached to the surface of the vibrating base plate 2 via an adhesive 4.

In this case, the thickness t of the oscillating base plate 2 of the oscillating device 1, is determined to be an integer multiple of approximately a half-wavelength of a wavelength of a drive oscillating signal by which the ultrasonic transducer 3 is driven. In other words:

$$t = \tfrac{1}{2}\lambda N$$

wherein N is an integer.

The frequency of the drive oscillating signal is determined to be coincident with a resonance frequency of the vibrating base plate 2 oscillating in the direction of its thickness. Therefore, the thickness t of the vibrating base plate 2 is an integer multiple of approximately a half-wavelength of the oscillation of the vibrating base plate 2.

For example, when the speed of the ultrasonic wave propagating the vibrating base plate 2 is 5100 m/s, and the frequency of the drive oscillating signal is determined to be one MHz, then the half-wavelength is 2.55 mm. Hence, the thickness of the vibrating base plate 2 is determined to an integer multiple of the half-wavelength of 2.55 mm.

In this embodiment, when driving the vibrating base plate by the drive oscillating signal having one MHz frequency, the vibrating base plate 2 resonates and accordingly the acoustic loss is reduced as compared with the conventional device in which a 50 μm thick vibrating base plate, i.e. approximately 1/100 of the wavelength, is used.

Figure 6:
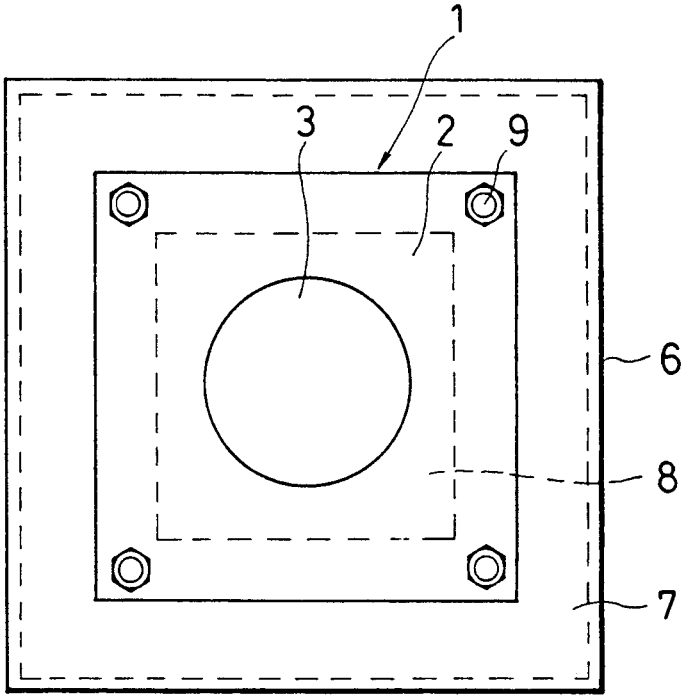
FIGS. 6–8 are bottom views of different embodiments of the present invention corresponding to FIG. 2.
Figure 7:
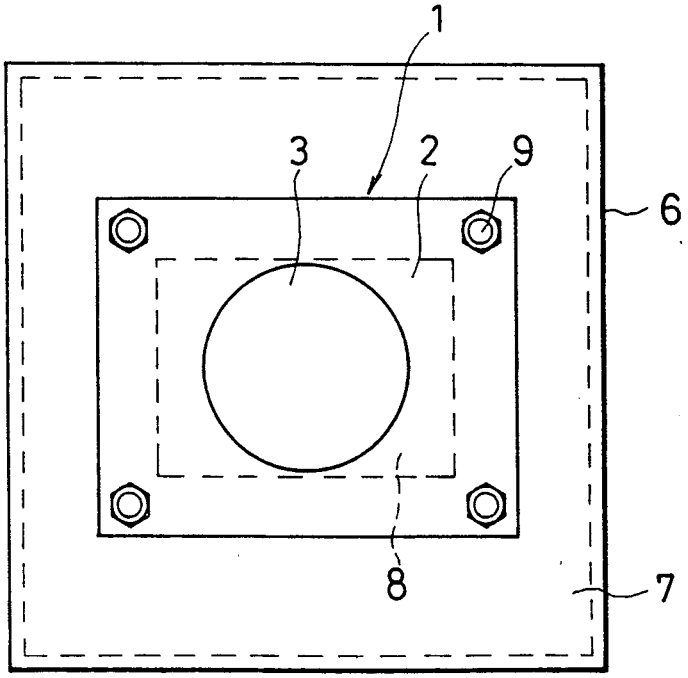

In this case, when the vibrating base plate 2 is substantially in the shape of a quadrilateral (when viewed in the direction of thickness t) such as being substantially in the shape of a square (FIG. 6) or a rectangle (FIG. 7), the length of one side of the quadrilateral is determined to be at least a quarter-wavelength of the oscillation of the vibrating base plate. When the oscillating base plate is designed to be substantially in the shape of a circle, then the length of a diameter of the circle is determined to be at least a quarter-wavelength of the resonance frequency of the vibrating base plate 2.

In the embodiment described above, since the thickness of the vibrating base plate 2 is determined to an integer multiple of the half-wavelength of the oscillation of the vibrating base plate 2, the vibrating base plate 2 can resonate effectively even when the length of at least one side of the quadrilateral vibrating base plate 2 is determined to be at least the quarter-wavelength of the oscillation of the vibrating base plate. Hence, no out-of-phase oscillating waves over the vibrating base plate 2 occur. Thus, effective and even ultrasonic oscillations can be generated from the entire surface of the vibrating base plate of the ultrasonic oscillating device.

Accordingly, when the ultrasonic oscillating device according to the present invention is applied to an ultrasonic washing apparatus, the high-energy ultrasonic wave having a high-frequency of at least 100 kHz can be emitted. Accordingly, the superior washing effect can be obtained without being affected by an oscillation in the direction of the length of the vibrating base plate.

Figure 2:
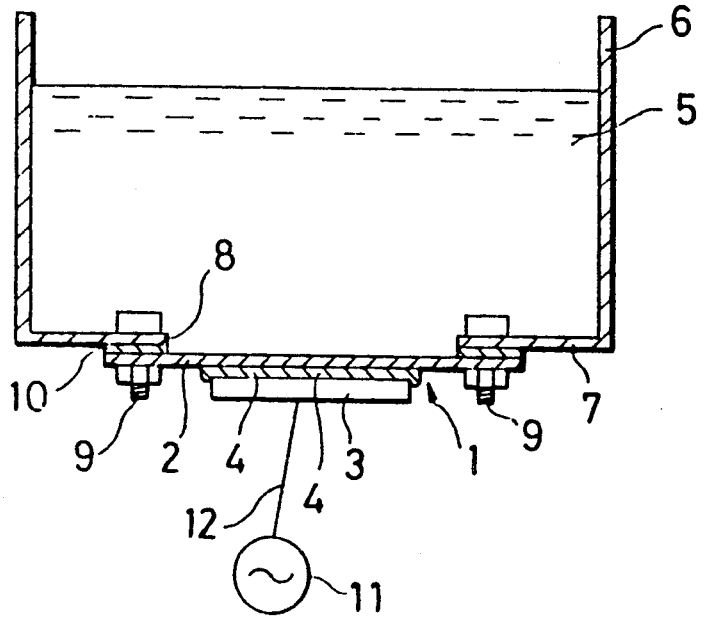
FIG. 2 ia a longitudinal, cross-section view of an ultrasonic washing apparatus using the ultrasonic oscillating device of FIG. 1 according to the present invention.
Figure 3:
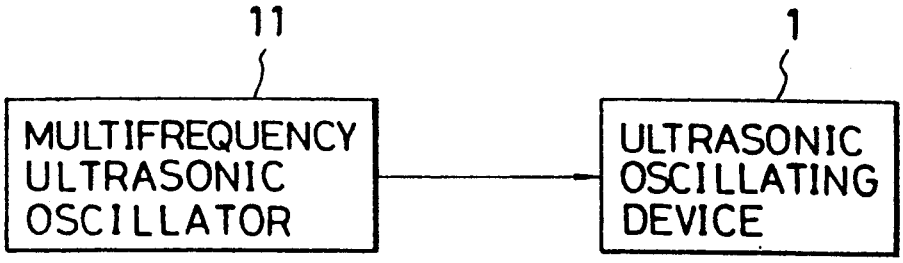
FIG. 3 is a schematic block diagram of a typical structure of the ultrasonic washing apparatus of the present invention.

An ultrasonic washing apparatus is shown in FIG. 2 using the ultrasonic oscillating device described above, according to the present invention. FIG. 3 illustrates . typical structure and interrelationship within the ultrasonic washing apparatus of FIG. 2.

In the drawings, a cleaning tank 6 for containing cleaning liquid 5 is provided with an opening 8 in a bottom plate 7, with the ultrasonic oscillating device 1 being mounted onto the bottom opening part 7 through a packing 10 by bolts 9 and nuts, so as to seal the opening 8.

The ultrasonic transducer 3 of the ultrasonic oscillating device 1 is connected to a high-frequency electric power source such as a multifrequency ultrasonic oscillator 11 via a cable 12. The ultrasonic oscillator 11 outputs a drive oscillating signal to the ultrasonic transducer 3 via the cable 12, in order to drive the ultrasonic oscillating device 1, resulting in the ultrasonic oscillating device 1 emitting the ultrasonic wave into the cleaning liquid 5 of the tank 6.

In this embodiment, the multifrequency oscillator 11 is provided with an oscillating circuit for a fundamental frequency $f_O$ which is a minimum oscillation and with other oscillating circuits for odd number multiple frequencies $mf_O$ (m is an odd number of at least three) of the fundamental frequency $f_O$. The frequency of the drive oscillating signal output from the multifrequency oscillator 11 is selected at will in a manual or automatic manner.

Accordingly, by properly determining the frequency of the drive oscillating signal, ultrasonic waves of different frequencies may be emitted into the items to be cleaned. Hence a variety of items can be effectively cleaned by the ultrasonic cleaning apparatus according to the present invention.

A drive oscillating signal having an even number multiple frequency of the fundamental frequency is not used in this embodiment, because the harmonic elements negatively influence cleaning effectiveness. To the contrary, there is no reduction in cleaning effectiveness when using a drive oscillating signal having an odd number multiple frequency of the fundamental frequency.

Figure 4:
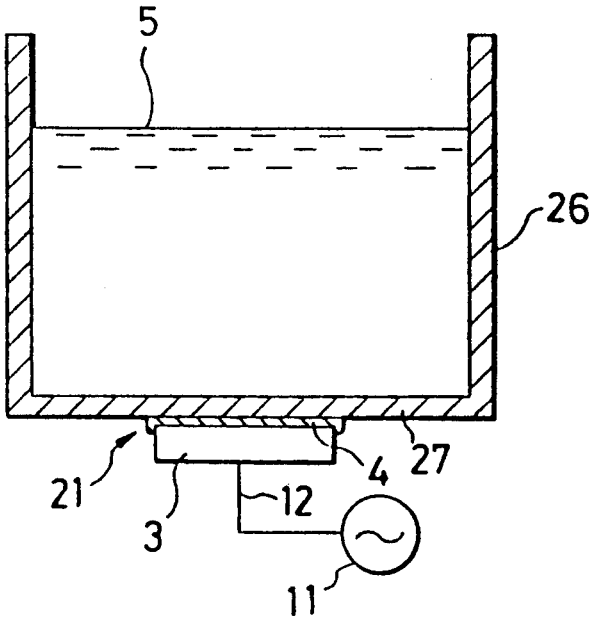
FIG. 4 is a longitudinal, cross-sectional view of another embodiment of an ultrasonic washing apparatus according to the present invention.

Another washing apparatus according to the present invention is shown in FIG. 4. In this embodiment (the ultrasonic oscillating device being indicated by reference 21), the ultrasonic transducer 3 is directly attached to a bottom plate 27 of a cleaning tank 26 through the adhesive 4. Hence, the bottom plate 27 of the tank 26 functions both as the bottom plate and as a vibrating base plate. Accordingly, the thickness of the bottom plate 27 of the tank 26 is selected or determined to be an integer multiple of approximately the half-wavelength of the oscillation of the bottom plate 27, with the length of at least one side of the quadrilateral bottom plate 27 of the tank 26 being determined or selected to be at least the quarter-wavelength of the oscillation of the bottom plate 27. Alternatively, if the cleaning tank 26 is substantially cylindrically shaped, then the substantially circular bottom plate 27 has a diameter which is at least; a quarter-wavelength of the oscillation of the bottom plate 27. In these cases, the same effects and advantages can be attained as with the first washing apparatus described above with reference to FIG. 2.

Figure 5:
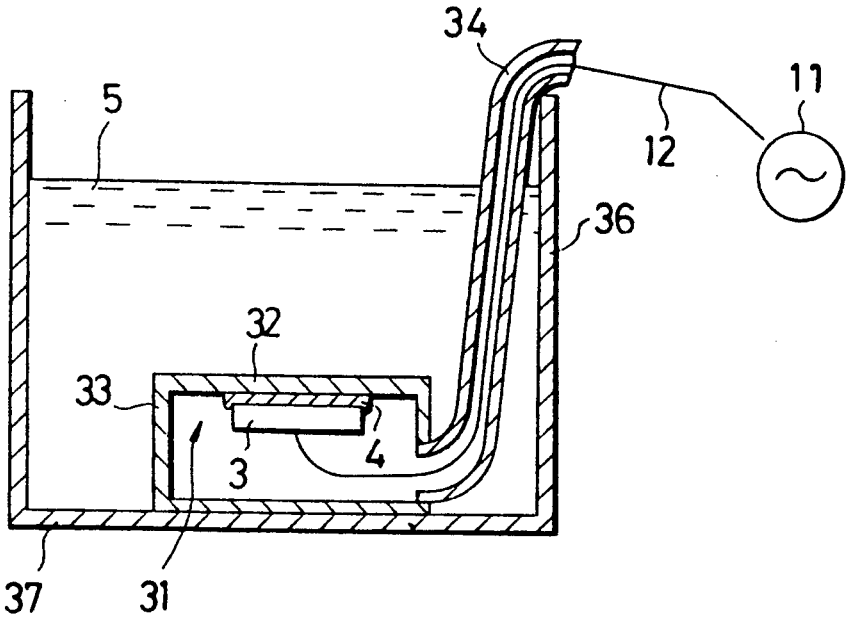
FIG. 5 is a longitudinal, cross-sectional view of a further embodiment of an ultrasonic washing apparatus according to the present invention

A further washing apparatus according to the present invention is shown in FIG. 5. In this so-called "throw-in" type washing apparatus (the ultrasonic oscillating device being indicated by reference No. 31), an oscillating box 33 is "thrown" or situated in the cleaning liquid of a cleaning tank 36. The oscillating box 33 comprises an airtight hollow box having an upper plate 32, in ultrasonic transducer 3 attached to the upper plate 32 from inside through the adhesive 4, and an airtight cable leading tube 34 mounted onto the side of the hollow box 33 and communicating with the interior thereof. Reference No. 37 denotes the bottom plate of the cleaning tank 36.

In this embodiment, the upper plate 32 of the box 33 functions as the vibrating base plate. Therefore, the thickness of the upper plate 32 of the oscillating box 33 is determined or selected to be an integer multiple of approximately the half-wavelength of the oscillation of the upper plate 32, with the length of at least one side of the quadrilateral upper plate 32 of the oscillating box 33 being selected or determined to be at least the quarter-wavelength of the oscillation of the upper plate 32. Alternatively, if the upper plate 32 is substantially circular, then a diameter thereof is at least the quarter-wavelength of the oscillation of the upper plate 32. In these cases, the same effects and advantages are accordingly attained as those of the first and second ultrasonic washing apparatus described above with respect to FIGS. 2 and 4.

Figure 8:
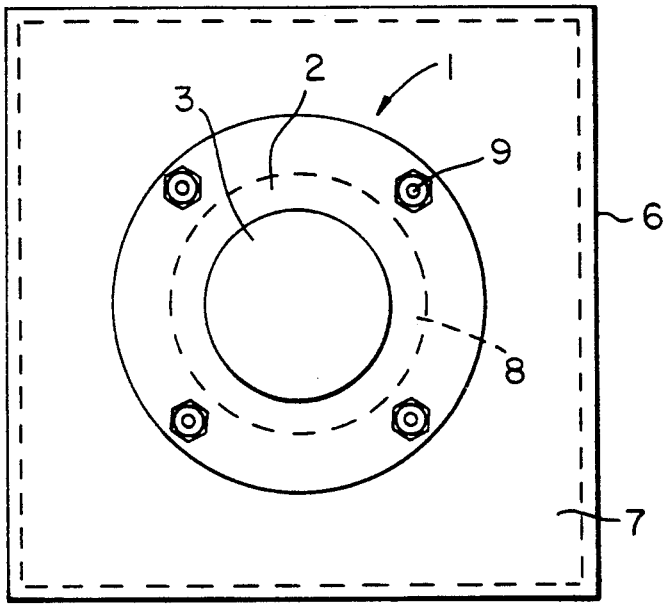

Although the vibrating base plate 2, the bottom plate 27 of the tank 26, and the upper plate 32 of the oscillating box 33 are substantially in the shape of a quadrilateral such as a square (FIG. 6) or a rectangle (FIG. 7) in the first, the second, and third embodiments of the ultrasonic washing apparatus according to the present invention, such members however may naturally be substantially in the shape of a circle (FIG. 8), while a length of a diameter of the circle may be at least a quarter-wavelength of the oscillation of such members.

According to the present invention, when the ultrasonic transducer is driven by the ultrasonic multifrequency oscillator, since the thickness of the oscillating base plate is determined to be approximately the half-wavelength of the oscillation of the base plate, the vibrating base plate may oscillate approximately at its own oscillation, even if the thickness of the vibrating base plate is enlarged.

Since the vibrating base plate oscillates approximately at the oscillation, even when the length of the one side of the vibrating base plate (or diameter thereof) is enlarged to more than a quarter-wavelength of the oscillation the phase difference among the oscillating waves emitted from the entire area of the vibrating base plate driven by the drive oscillating signal output from the ultrasonic oscillator, hardly occurs.

According to the present invention as described above, it is unnecessary to greatly reduce the thickness of the vibration plate, or the thickness of the vibration plate may be easily increased so as to be sufficiently strong when the frequency of the drive oscillating signal is either low or as high as at least 100 kHz. Hence, the ultrasonic oscillating device may be designed to have sufficient mechanical strength. Accordingly, deformation and the breaking of the vibration plate by the pressure of the cleaning fluid can be effectively prevented, while the sticking of the ultrasonic transducer onto the vibration plate can be readily accomplished. Thus, since erosion can be prevented, the life of the ultrasonic oscillating device during the emitting of ultrasonic waves can be extended. Furthermore, effective and even oscillating energy can be obtained at a high-frequency.

According to the present invention, since the thickness of the vibrating base plate is so determined as to effectively resonate with the frequency of the drive oscillating signal or the oscillation of the vibrating base plate, there is no need to provide a controller for resonating the vibrating base plate depending upon its thickness. Hence, the acoustic loss may be effectively reduced as compared with the conventional device using a thin vibrating base plate.

Furthermore, no phase lag occurs among the oscillating waves emitted from the entire area of the vibrating base plate when the length of at least one side of the quadrilateral vibrating base plate (or the diameter thereof in the case where the base plate is in the shape of circle) is determined to be at least a quarter-wavelength of the oscillation of the vibrating base plate. Therefore, effective and even ultrasonic waves can be emitted from the entire surface of the vibrating base plate.

According to the present invention, it is readily understood that since the drive oscillating signals of the fundamental frequency and the odd number multiple frequencies of the fundamental frequency in the ultrasonic multi-frequency oscillator may be selected at will, various kinds of dirt and contamination attached to the items to be washed or cleaned may be effectively removed by using the ultrasonic washing apparatus of the present invention.

Although the present invention has been described with respect to preferred embodiments thereof with reference to the accompanying drawings, it is readily understood that various changes and modifications may be made without departing from the spirit and scope of the present invention herein.

I claim:

1. An ultrasonic washing apparatus, comprising:

a tank for containing cleaning liquid;

an ultrasonic oscillating device for emitting an ultrasonic wave into the cleaning liquid of the tank; and an ultrasonic oscillator for outputting a drive signal to the ultrasonic oscillating device, wherein the ultrasonic oscillator is a multifrequency oscillator constituting means for outputting a drive oscillating signal having a fundamental frequency and an odd number multiple of the fundamental frequency, and wherein the ultrasonic oscillating device comprises a base plate and an ultrasonic transducer attached to the base plate, the base plate having a thickness which is an integer multiple of approximately a half-wavelength of a resonance frequency of the base plate oscillating in the direction of the thickness thereof, and in which the base plate is in the shape of a quadrilateral with a length of one side to the quadrilateral being at least a quarter-wavelength of the resonance frequency of the base plate.

2. The ultrasonic washing apparatus f claim 1, wherein the base plate is substantially in eh shape of a square.

3. The ultrasonic washing apparatus of claim 1, wherein the base plate is substantially in the shape of a rectangle.

4. The washing apparatus of claim 1, wherein the tank comprises an opening in a bottom wall thereof, with said oscillating device sealingly mounted in said bottom opening.

5. The washing apparatus of claim 1, wherein said base plate is a bottom plate of the tank.

6. The washing apparatus of claim 1, wherein said ultrasonic oscillating device is in the form of an airtight, hollow, oscillating box sealingly mounted within said tank, with an upper plate of said oscillating box being said base plate, and said transducer attached to said upper plate from inside said oscillating box, and an airtight cable-leading tube mounted on a said of said oscillating box.

7. An ultrasonic oscillating device comprising:

a tank comprising a base plate and comprising four sides connected to said base plate, said tank functioning to hold a washing liquid;

an ultrasonic transducer attached to said base plate;

wherein said base plate has a thickness which is an integer multiple of approximately a half-wavelength of an ultrasonic oscillation of said base plate in the direction of the thickness thereof under a driving ultrasonic frequency, wherein said base plate has a periphery substantially in he shape of a quadrilateral with a length of one side of said quadrilateral being at least a quarter-wavelength of said ultrasonic oscillation of said base plate, a multifrequency ultrasonic oscillator connected to said ultrasonic transducer in order to drive the same, said oscillator constituting means for outputting a drive oscillating signal having a fundamental frequency and an odd number multiple of the fundamental frequency, said ultrasonic oscillation being transmitted into said washing liquid whereby cleaning efficiency of said liquid is improved.

8. The ultrasonic oscillating device of claim 7 wherein said base plate is substantially in the shape of a square.

9. The ultrasonic oscillating device of claim 7 wherein said base plate is substantially in the shape of a rectangle.

* * * * *